United States Patent [19]

Satoh et al.

[11] Patent Number: 4,858,649

[45] Date of Patent: Aug. 22, 1989

[54] VALVE APPARATUS

[75] Inventors: Shinichi Satoh, Ibaraki; Toichi Hirata, Ushiku; Genroku Sugiyama; Hideaki Tanaka, both of Ibaraki, all of Japan

[73] Assignee: Hitachi Construction Machinery Co., Ltd., Tokyo, Japan

[21] Appl. No.: 221,509

[22] PCT Filed: Sep. 7, 1987

[86] PCT No.: PCT/JP87/00662

§ 371 Date: Apr. 29, 1988

§ 102(e) Date: Apr. 29, 1988

[87] PCT Pub. No.: WO88/02071

PCT Pub. Date: Mar. 24, 1988

[30] Foreign Application Priority Data

Sep. 9, 1986 [JP] Japan ..... 61-137360[U]
Sep. 10, 1986 [JP] Japan ..... 61-137949[U]

[51] Int. Cl.[4] ..... F15B 13/042
[52] U.S. Cl. ..... 137/625.6; 137/625.63
[58] Field of Search ..... 91/419, 443; 137/625.6, 137/625.63

[56] References Cited

U.S. PATENT DOCUMENTS 3,304,953 2/1967 Wickline et al. ..... 137/625.6 X
4,753,158 6/1988 Hirata et al. ..... 91/461

FOREIGN PATENT DOCUMENTS 37-26272 9/1962 Japan .
56-34161 4/1981 Japan .
160408 12/1981 Japan .
57-58106 4/1982 Japan .

*Primary Examiner*—Gerald A. Michalsky
*Attorney, Agent, or Firm*—Antonelli, Terry & Wands

[57] ABSTRACT

A valve apparatus (1; 50; 60, 61; 90; 100) in which at least one flow control valve (21, 22; 63, 76; 101) is incorporated in a body block (20; 62, 82), and the flow control valve is connected in pilot lines (6–9) which connect a pilot valve (2) supplied with a pilot hydraulic fluid of a predetermined pressure set by a relief valve (19) and a pilot operated directional control valve (3) actuated in response to operation of the pilot valve, to permit free flow of the hydraulic fluid from the pilot valve to the directional control valve, but to restrict flow of the hydraulic fluid from the directional control valve to the pilot valve. The body block (20; 62, 82) is formed therein with a first passage (31; 52; 68, 81) connected to a return line (14; 71, 72, 86) for the relief valve (19).

4 Claims, 7 Drawing Sheets

VALVE APPARATUS

BACKGROUND OF THE INVENTION

The present invention relates to valve apparatuses and, particularly, to a valve apparatus comprising a flow control valve which is connected in pilot lines connecting a pilot valve and a pilot operated directional control valve to each other, for adjusting a switching speed of the pilot operated directional control valve.

U.S. Patent Application Serial No. 904,119, now U.S. Pat. No. 4,753,158 (which corresponds to EPC Patent Application No. 86112328.9 or Chinese Patent Application No. 86106036) discloses a pilot hydraulic circuit system in which a flow control valve has a restriction and a check valve connected to pilot lines connecting a pilot valve supplied with a pilot hydraulic fluid of a predetermined pressure set by a relief valve. A pilot operated directional control valve is actuated in response to operation of the pilot valve to permit free flow of the hydraulic fluid from the pilot valve to the directional control valve but also to restrict flow of the hydraulic fluid from the directional control valve to the pilot valve. Preferably, the flow control valve has added thereto a pressure compensating function making differential pressure across the restriction constant, so that the flow control valve is brought to a pressure-compensated flow control valve.

In general, in the conventional pilot hydraulic circuit system, when an operating lever is operated to return the pilot valve from an operating position to a neutral position, a return speed at which the directional control valve is returned to the neutral position is high. Therefore, a rise of in brake pressure generated in a main line becomes also extremely steep, so that large shock occurs on a hydraulic actuator which is controlled by the directional control valve.

In the pilot hydraulic circuit system disclosed in the above-mentioned patent application, by the action of the flow control valve, the hydraulic fluid flow is about to free flow when the pilot hydraulic fluid is supplied from the pilot valve to a pilot chamber of the directional control valve, but the check valve and the restriction function when the pilot hydraulic fluid is returned from the pilot chamber of the directional control valve to the pilot valve to restrict the flow of the hydraulic fluid. Also at this time, the flow rate of the restricted hydraulic fluid is pressure compensated so that the flow rate is maintained substantially constant. This causes the switching speed of the directional control valve to be adjusted to thereby eliminate the above-mentioned problem that the shock occurs on the hydraulic actuator.

For the flow control valve constructed as described above, the diameter of the restriction incorporated in the flow control valve must be made small because the flow rate of the pilot hydraulic fluid is low. In the case where the diameter of the restriction is small, however, the viscosity of the hydraulic fluid increases when the environmental temperature is low, and pressure loss of the hydraulic fluid passing through the restriction is increased so that the hydraulic fluid flows only at a flow rate lower than a set flow rate. In other words, the operating characteristic at low temperature deteriorates. This results in a difference in the switching speed of the directional control valve from season to season, in particular, between the summer season and the winter season, reducing stability of the operations of the hydraulic actuator.

SUMMARY OF THE INVENTION

It is, therefore, an object of the invention to provide a valve apparatus which can improve an operating characteristic of a flow control valve at low temperature.

The above object can be achieved by a valve apparatus comprising at least one flow control valve incorporated in a body block and connected in pilot lines connecting a pilot valve supplied with a pilot hydraulic fluid of a predetermined pressure set by a relief valve and a pilot operated directional control valve actuated in response to operation of the pilot valve, to permit free flow of the hydraulic fluid from the pilot valve to the directional control valve but also to restrict flow of the hydraulic fluid from the directional control valve to the pilot valve, wherein the body block is formed therein with a first passage connected to a return line for the relief valve.

Heat is generated at the relief valve when the pilot hydraulic fluid is relieved, and the relieved pilot hydraulic fluid is returned to a reservoir through the above-mentioned first passage. This causes the heat generated at the relief valve to be transmitted to the body block through the first passage, to keep the flow control valve warm. Accordingly, the viscosity of the hydraulic fluid flowing through the flow control valve is prevented from increasing even when the environmental temperature is low, thereby improving the operating characteristic at low temperature.

DETAILED DESCRIPTION OF PREFERRED EMBODIMENTS

Figure 1:
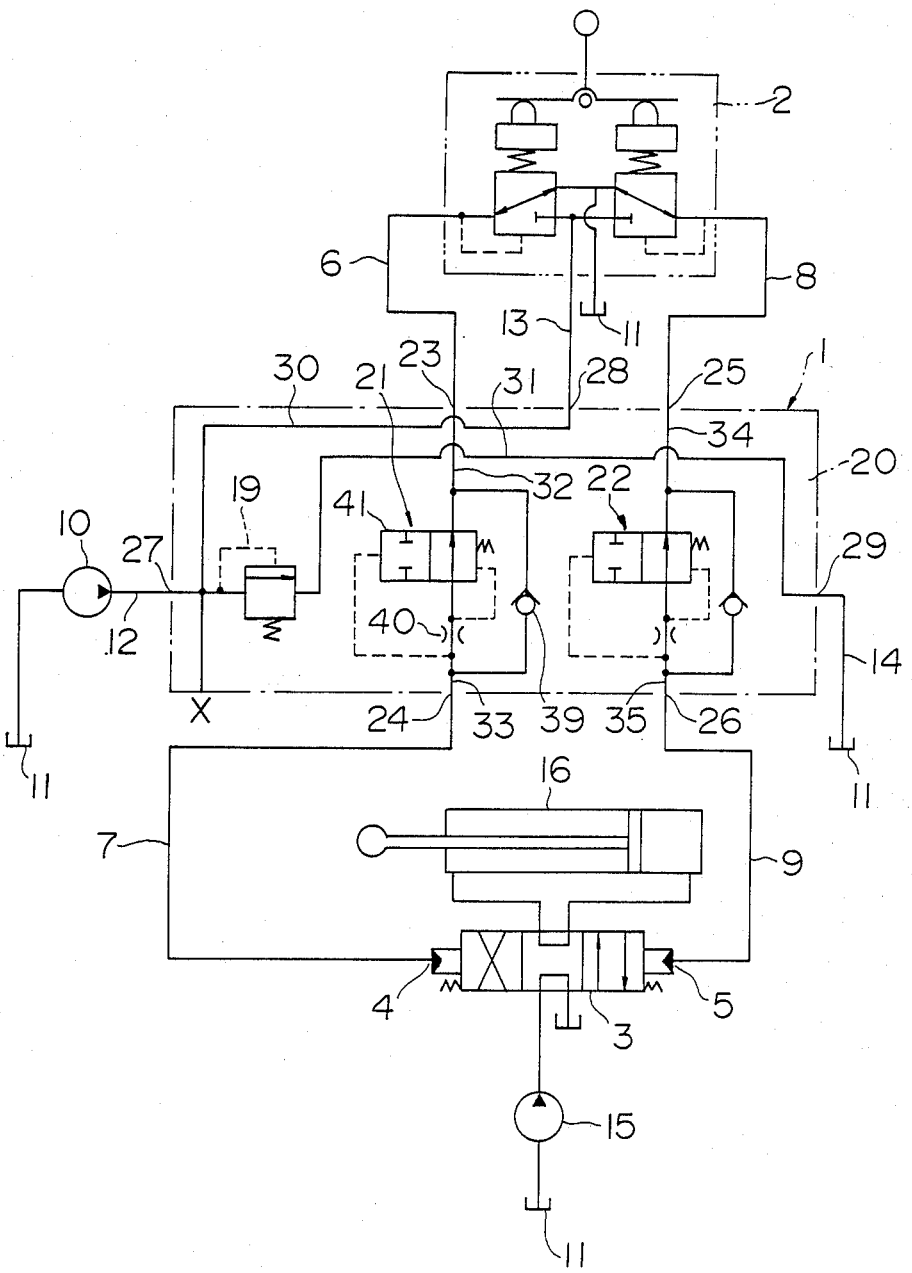
FIG. 1 is a circuit diagram showing a pilot hydraulic circuit system having incorporated therein a valve apparatus according to an embodiment of the invention.

In FIG. 1, the reference numeral 1 denotes a valve apparatus according to the invention. The valve apparatus 1 is connected between a pilot valve 2 and pilot chambers 4, 5 of a directional control valve 3 actuated in response to operation of the pilot valve 2, through pilot lines 6–9. The valve apparatus 1 is also connected, through a supply line 12, to a pilot pump 10 which supplies a pilot hydraulic fluid to the pilot valve 2. The valve apparatus 1 is connected to the pilot valve 2 and a reservoir 11 respectively through a supply line 13 and a return line 14.

The directional control valve 5 is arranged in a main circuit constituted by a main pump 15 and a hydraulic actuator 16. Operation of the directional control valve 5 controls a flow rate and a direction of the hydraulic fluid supplied from the main pump 15 to the hydraulic actuator 16.

Figure 2:
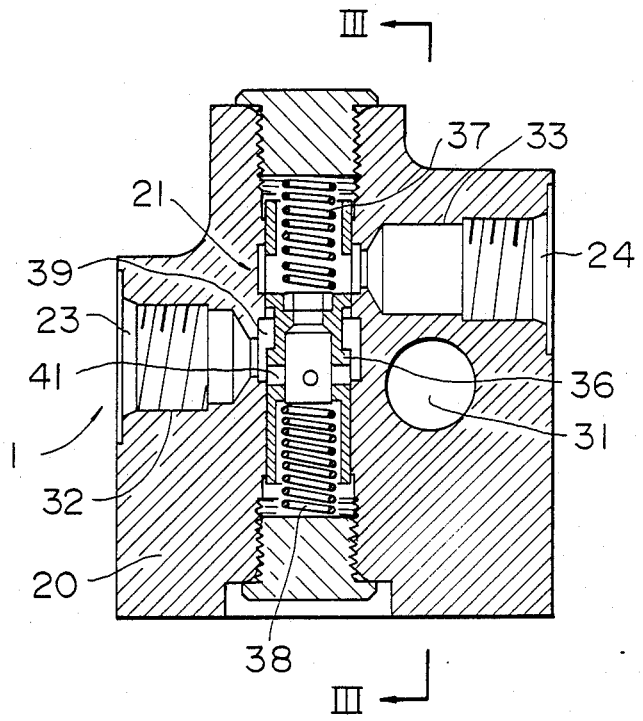
FIG. 2 is a cross-sectional view showing the structure of the valve apparatus.
Figure 3:
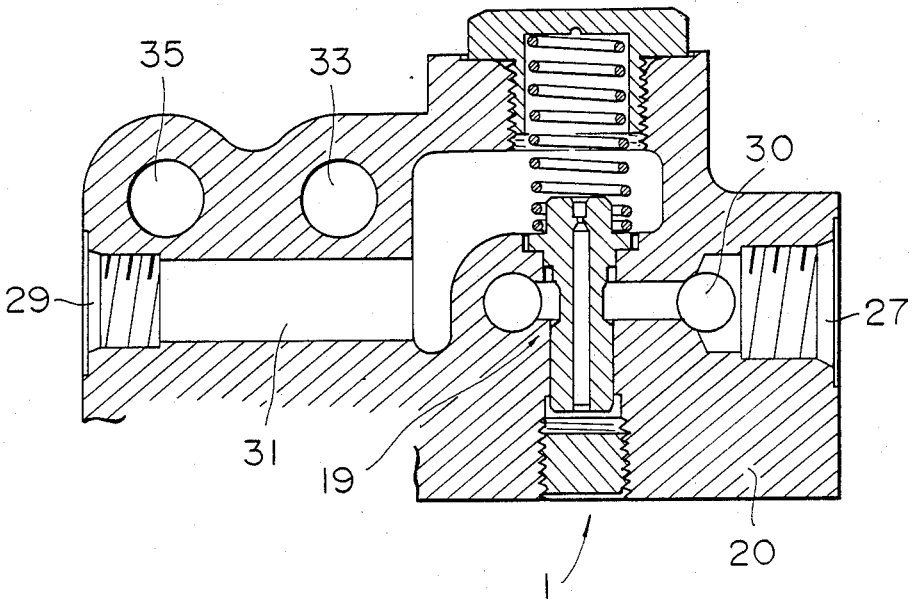
FIG. 3 is a cross-sectional view taken along line III—III in FIG. 2.

Referring also to FIGS. 2 and 3, the valve apparatus 1 comprises a body block 20 which has incorporated therein flow control valves 21, 22 and a relief valve 19. The body block 20 is also formed with ports 23–29 and internal passages 30, 31. The ports 23, 24 are connected respectively to the pilot lines 6, 7. The flow control valve 21 is located between passages 32, 33 communicating respectively with the ports 23, 24. The ports 25, 26 of the flow control valve 22 are connected respectively to the pilot lines 8, 9. The flow control valve 22 is located between passages 34, 35 communicating respectively with the ports 25, 26. The ports 27, 28 are connected respectively to the supply lines 12, 13, and communicate with each other within the body block 20 through the passage 30. The relief valve 19 is connected to the passage 30 to set a pressure of the pilot hydraulic fluid supplied to the pilot valve 2. The port 29 is connected to the return line 14, and an outlet of the relief valve 19 communicates with the return line 14 through the passage 31 and the port 29. The passage 31 extends through the neighborhood of both the flow control valves 21, 22.

The flow control valve 21 has its structure described in the above-mentioned U.S. Patent Application Ser. No. 904,119, now U.S. Pat. No. 4,753,158 which corresponds to EPC Patent Application No. 86112328.9 or Chinese Patent Application No. 86106036). Stated briefly, the flow control valve 21 has a spool 36 which is slidably housed across the passages 32,33. On the opposite sides of the spool 36, pressure chambers 37, 38 are respectively provided, and communicate respectively with the passages 32, 33. The spool 36 has a check valve 39 at an outside central portion of the spool, and has a restriction 40 at an inside central portion of the spool. The spool 36 is also provided with a pressure compensating control orifice 41 which reduces an opening degree by displacement of the spool 36 occurring in response to a differential pressure generated across the restriction 40 to maintain the flow rate of the hydraulic fluid constant.

The flow control valve 22 is the same in construction as the flow control valve 21, and the relief valve 19 has a conventional construction.

In the pilot hydraulic circuit system including such valve apparatus 1, when an operating lever of the pilot valve 2 is moved down, for example, to the left as viewed in FIG. 1, the pilot hydraulic fluid from the pilot pump 10 is led to a left-hand valve section of the pilot valve 2 through the passage 30 and the port 28 of the valve apparatus 1, and is further led to the pilot chamber 4 of the directional control valve 3 through the port 23, the flow control valve 21 and the port 24 of the valve apparatus 1. On the other hand, the hydraulic fluid within the pilot chamber 5 of the directional control valve 3 is led to the flow control valve 22 through the port 26 of the valve apparatus 1. The flow rate of the hydraulic fluid is controlled at the flow control valve 22. The hydraulic fluid further passes through the port 25 and the pilot valve 2 and is returned to the reservoir 11. Control of the flow rate at this time restricts the flow rate and pressure compensates by the restriction 40 and the control orifice 41. By this flow of the hydraulic fluid, the directional control valve 3 is switched to a left-hand position in the figure, while the directional control valve 3 is adjusted in its switching speed. Thus, the hydraulic fluid from the main pump 15 is supplied to a head side of the hydraulic actuator 16 so that the hydraulic actuator 16 performs its extending operation.

When the operating lever of the pilot valve 2 is moved down to the right instead of to the left, the pilot hydraulic fluid from the pilot pump 10 is led to a right-hand valve section of the pilot valve 2 through the passage 30 and the port 28 of the valve apparatus 1, and is further led to the pilot chamber 5 of the directional control valve 5 through the port 25, the flow control valve 22 and the port 26 of the valve apparatus 1. On the other hand, the hydraulic fluid within the pilot chamber 4 of the directional control valve 5 is led to the flow control valve 21 through the port 24 of the valve apparatus 1. The hydraulic fluid is controlled in flow rate at the flow control valve 21. The hydraulic fluid further passes through the port 23 and the pilot valve 2 and is returned to the reservoir 11. Control of the flow rate at this time is a control in which the flow rate is restricted and is compensated in pressure by the restriction 40 and the control orifice 41. By this flow of the hydraulic fluid, the directional control valve 3 is switched to a right-hand position in the figure, while the directional control valve 3 is adjusted in switching speed. Thus, the hydraulic fluid from the main pump 15 is supplied to a rod side of the hydraulic actuator 16 so that the actuator 16 performs its retracting operation.

In such a state that the pilot valve 2 is retained, for example, at a neutral position, communication between the supply line 13, and the pilot lines 6, 8 are interrupted so that the passage 30 within the valve apparatus 1 is closed. Thus, the pilot hydraulic fluid from the pilot pump 10 is led to the passage 31 through the relief valve 19, and is further led to the reservoir 11 through the port 29 and the return line 14. As a result, heat generated at the relief valve 19 is transmitted to the entire body block 20 through the passage 31, so that the flow control valves 21, 22 are kept warm. In the illustrated embodiment, since the passage 31 is arranged in the vicinity of the flow control valves 21, 22, the maintenance of warmth is excellent. Moreover, since the relief valve 19 is also incorporated in the valve apparatus 1, relief heat is transmitted also from the relief valve 19 to the body block 20. Thus, the flow control valves 21, 23 are kept warm in a more desired manner.

In the valve apparatus 1 constructed as described above, since the flow control valves 21, 22 are kept warm even when the environmental temperature is low, the viscosity of the hydraulic fluid flowing through these flow control valves 21, 22 can be maintained constant to prevent the viscosity from increasing. Thus, it is possible to maintain constant the switching speed of the directional control valve 3 without being influenced by the environmental temperature, so that safety of the operations performed by the hydraulic actuator 16 can be ensured.

Figure 4:
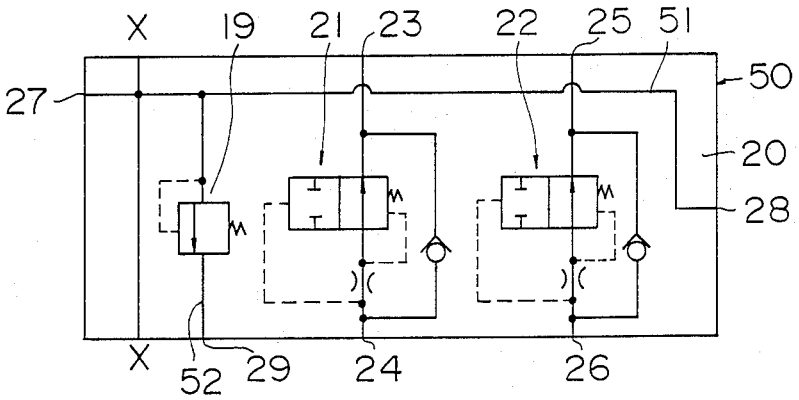
FIG. 4 is a circuit diagram of a valve apparatus according to another embodiment of the invention.

FIG. 4 shows a valve apparatus 50 according to a modification of the above-described embodiment. In the figure, parts of components similar to those illustrated in FIG. 1 are designated by the same reference numerals.

The valve apparatus 50 has passages 51, 52 which extend in a fashion diffeent from the above-described first embodiment. The passage 52 which transmits heat generated at the relief valve 19 to the body block 20 is arranged in the vicinity of only the flow control valve 21. This embodiment is preferable if it will suffice that keeping warm of, in particular, only the flow control valve 21 is taken into consideration.

Another embodiment of the invention will be described with reference to FIGS. 5 and 6. In these figures, parts or components similar to those illustrted in FIG. 1 are designated by the same reference numerals.

In this embodiment, separate valve apparatuses 60, 61 are connected respectively to the pilot lines 6, 7 and the pilot lines 8, 9. The relief valve 19 is arranged on the outside of the valve apparatuses 60, 61 in the usual manner.

Figure 6:
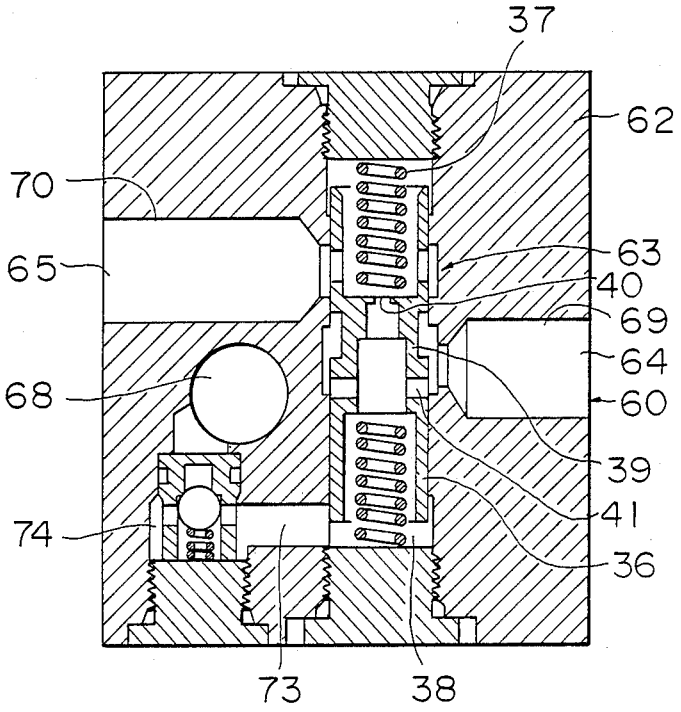
FIG. 6 is a cross-sectional view showing the structure of the valve apparatus.

Referring also to FIG. 6, the valve apparatus 60 has a body block 62 in which a flow control valve 63 is incorporated. The body block 62 is formed with ports 64–67 and an internal passage 68. the ports 64, 65 are connected respectively to the pilot lines 6, 7. The flow control valve 63 is located between passages 69, 70 communicating respectively with the ports 64, 65. The ports 66, 67 are connected respectively to return lines 71, 72 communicating the outlet of the relief valve 19 with the reservoir 11, and communicate with each other within the body block 20 by the passage 68. The passage 68 extends through the neighborhood of the flow control valve 63.

The body block 62 is also formed therein with a passage 73 which communicates the above-mentioned passage 68 with the passage 69. Provided in the passage 73 is a check valve 74 which prevents flow of the hydraulic fluid from the passage 69 to the passage 68.

The flow control valve 63 is the same in construction as the flow control valves 21, 22 of the embodiment described previously, and parts or components forming the flow control valve 63 are therefore designated by the same reference numerals as those of the flow control valves 21, 22.

Another valve apparatus 61 is similar in construction to the above-mentioned valve apparatus 60. In particular, a body block 75 has incorporated therein a flow control valve 76, and is formed with ports 77–80 and passages 81–84. A check valve 85 is provided in the passage 84. However, ports 79, 80 of the passage 80 corresponding to the passage 68 are connected respectively to the return passage 71 and a return passage 86.

In a pilot hydraulic circuit system having such valve apparatuses 60, 61, when the operating lever of the pilot valve 2 is moved down to the left or the right, operations are effected which are substantially the same as those of the embodiment described previously.

When the pilot valve 2 is retained at the neutral, the hydraulic fluid discharged from the pilot pump 10 flows to the return line 71 through the relief valve 19. This hydraulic fluid warmed by heat generated at the relief valve 19 is further led to the reservoir 11 through the passages 68, 81 of the respective valve apparatuses 60, 61. In this state, within the valve apparatuses 60, 61, parts of the hydraulic fluid also flow from the passages 68, 81 respectively into the passages 73, 84. The hydraulic fluid is led from these passages 73, 84 to the pilot lines 6, 8 through the passages 69, 82 and, subsequently, is returned to the reservoir 11.

Thus, the hydraulic fluid warmed by heat generated at the relief valve 19 keeps warm the body blocks 62, 75 and the flow control valves 63, 76 of the valve apparatuses 60, 61 through the passages 68, 81 and the passages 73, 84. The hydraulic fluid also flows through the passages 69, 82 into the pilot lines 6, 8, to thereby keep warm the body blocks 62, 75 and the flow control valves 63, 76 in a better manner.

Thus, this embodiment, like the first embodiment, also improves the operating characteristic of the flow control valves 63, 76 at low temperature, making it possible to secure stability of the operations by the actuator 16.

Figure 7:
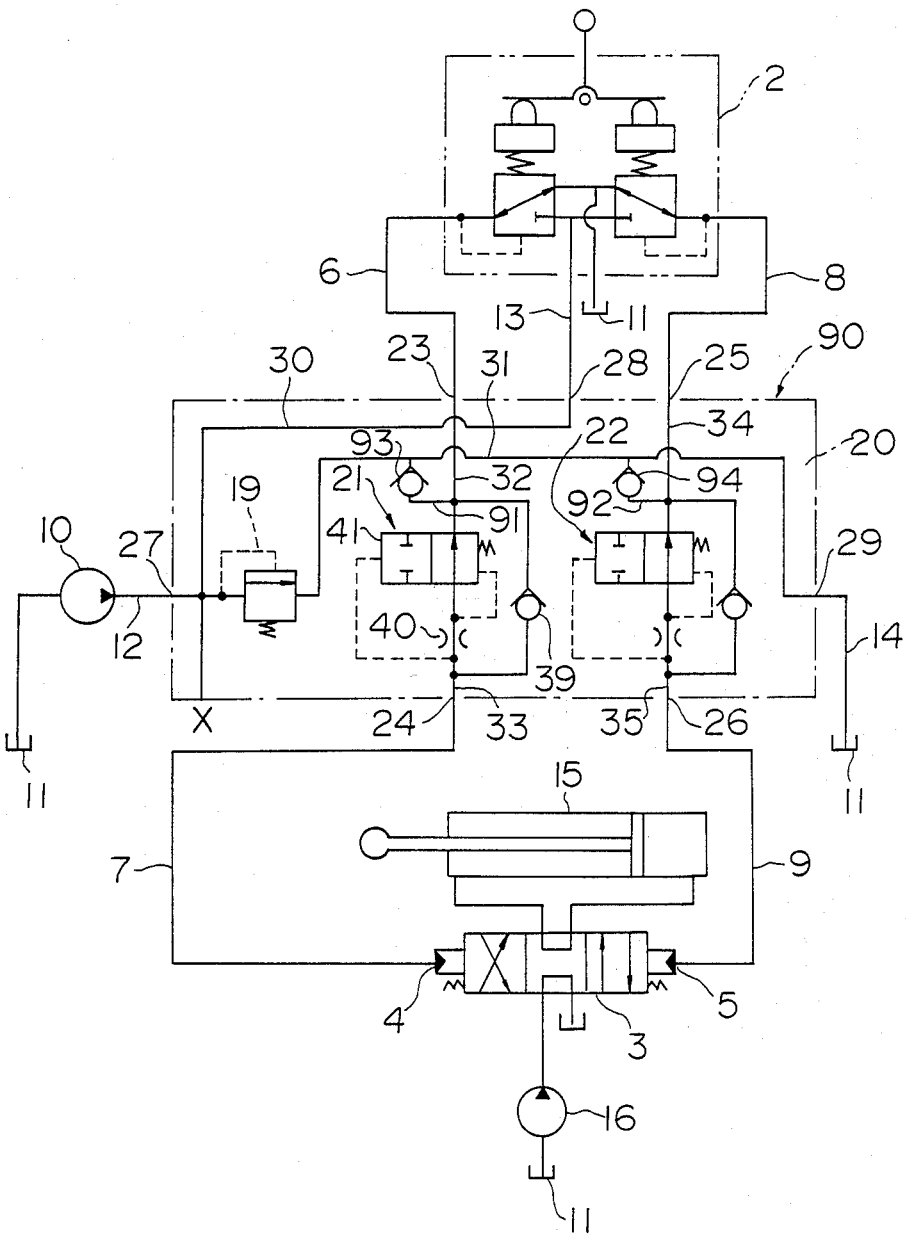
FIG. 7 is a circuit diagram showing a pilot hydraulic circuit system having incorporated therein a valve apparatus according to still further embodiment of the invention.
Figure 8:
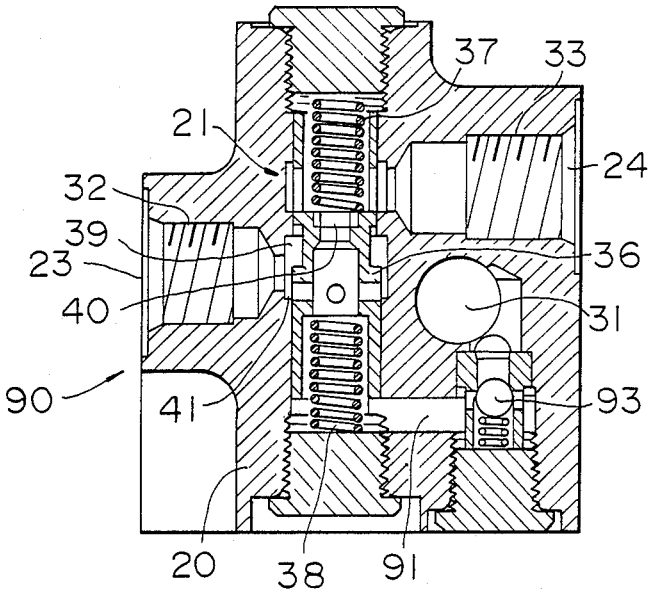
FIG. 8 is a cross-sectional view showing the structure of the valve apparatus.

Still another embodiment of the invention will be described with reference to FIGS. 7 and 8. In these figures, parts or components similar to those of the first embodiment illustrated in FIGS. 1 through 3 are designated by the same reference numerals.

Figure 5:
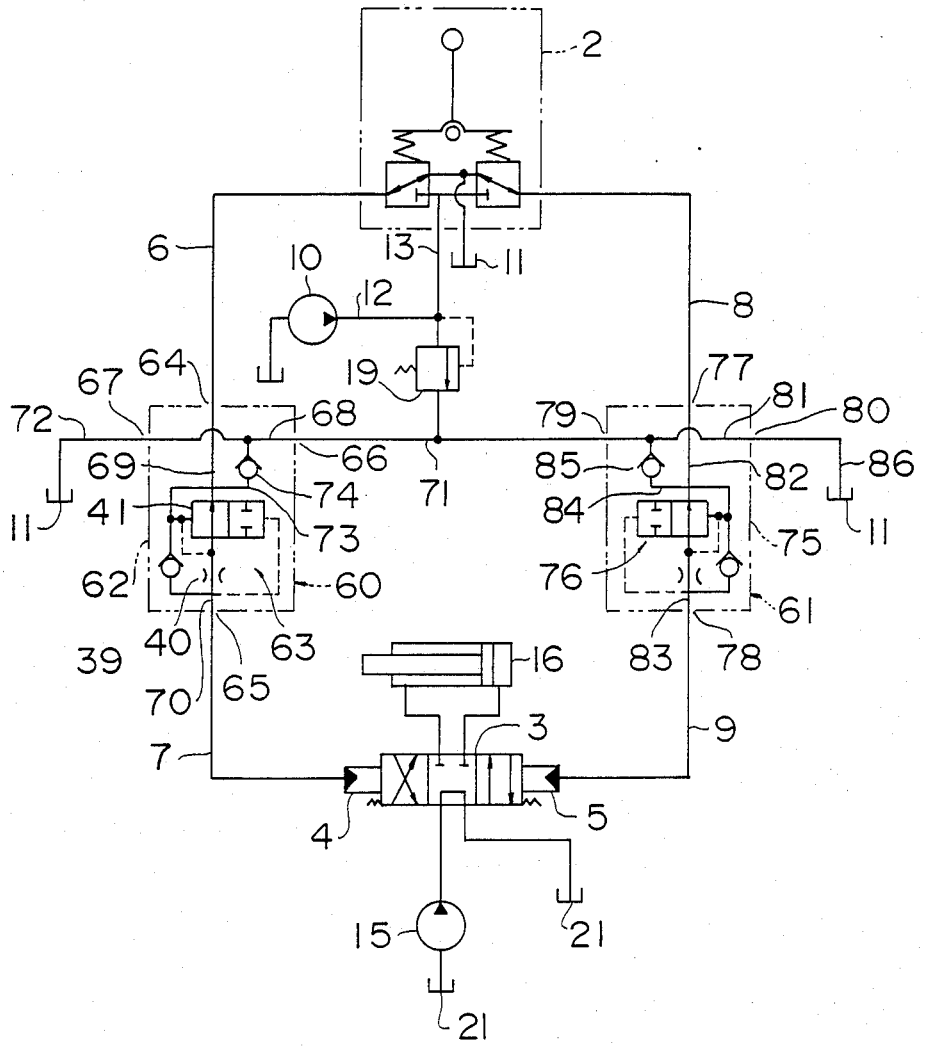
FIG. 5 is a circuit diagram showing a pilot hydraulic circuit system having incorporated therein a valve apparatus according to still another embodiment of the invention.

A valve apparatus 90 of this embodiment is one in which an arrangement corresponding to the passage 73, 84 and the check valves 74, 85 of the embodiment illustrated in FIG. 5 is added to the arrangement of the above-described first embodiment. The body block 20 of the valve apparatus 90 is formed therein with a passage 91 communicating the passage 31 with the passage 32, and a passage 92 communicating the passage 31 with the passage 34. These passages 91, 92 are provided therein respectively with check valves 93, 94 which prevent flow of the hydraulic fluid from the respective passages 32, 34 to the passage 31.

According to this embodiment, like the embodiment illustrated in FIG. 5, heat generated at the relief valve 19 is transmitted to the body block 20 also by the hydraulic fluid flowing to the pilot lines 6, 8 through the passages 91, 92 and the passages 32, 34, so that more excellent warmth retention of the flow control valves 21, 22 is achieved.

In all of the embodiments described above, the valve apparatus is provided with the pressure-compensated flow control valve or valves described in U.S. Patent Application Serial No. 904,119, now U.S. Patent No. 4,753,158 (which corresponds to EPC Patent Application No. 86112328.9 or Chinese Patent Application No. 86106036). However, the flow control valve is not limited to this example. The flow control valve may be a usual pressure-compensated flow control valve, or may be a flow control valve having no pressure compensating function.

Figure 9:
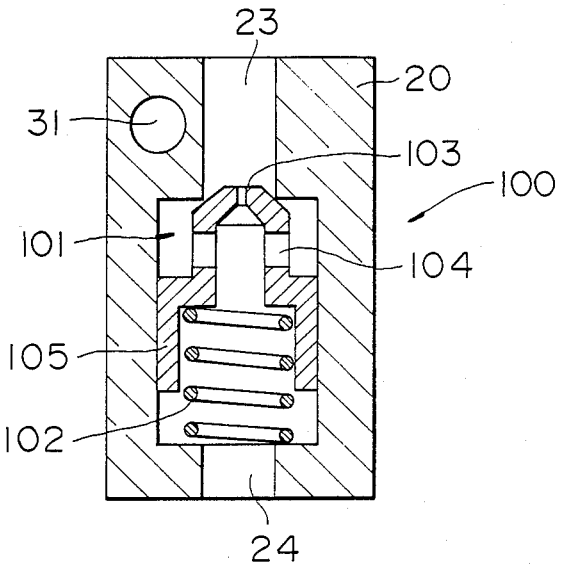
FIG. 9 is a cross-sectional view showing the structure of a valve apparatus according to still further embodiment of the invention.

FIG. 9 shows an embodiment of a valve apparatus having incorporated therein a flow control valve having no pressure compensating function. In the figure, parts or components similar to those illustrated in FIG. 1 are designated by the same reference numerals. The valve apparatus 100 of this embodiment has two flow control valves 101 incorporated in the body block 20. Each of the flow control valves 101 is arranged such that a spool 105 biased toward a closed position by a spring 102 and formed with a restriction 103 and a lateral bore 104 is slidably housed in the body block 20. As the hydraulic fluid is led to the port 23, the spool 105 is urged against the spring 102 to open the passage to permit the hydraulic fluid to freely flow through the lateral bore 104 and the port 24. As the hydraulic fluid is led to the port 24, flow of the hydraulic fluid is restricted by the restriction 103. Accordingly, this flow control valve 101 also permits free flow of the hydraulic fluid from the pilot valve 2 to the directional control valve 3 illustrated in FIG. 1, but restricts flow of the hydraulic fluid from the directional control valve 3 to the pilot valve 2.

In the body block 20, the passage 31 to which the hydraulic fluid flows from the relief valve 19 in accordance with the invention is formed in the vicinity of the flow control valve 101.

It will be apparent that this embodiment also obtains advantages similar to those of the above-described embodiments.

Although the above embodiments have been described as having two flow control valves arranged within the body block, the number of the flow control valves can be altered as occasion demands.

As will be apparent from the foregoing, according to the valve apparatus of the invention, the operating characteristic of the flow control valve at low temperature can be improved as compared with the conventional valve apparatus, and the switching speed of the directional control valve adjusted by the flow control valve can be maintained constant without being influenced by the environmental temperature. Thus, it is possible to secure safety of the operation of the hydraulic actuator.

What is claimed is:

1. A valve apparatus in which at least one flow control valve is incorporated in a body block and the flow control valve is connected in pilot lines which connect a pilot valve supplied with a pilot hydraulic fluid of a predetermined pressure set by a relief valve and a pilot operated directional control valve actuated in response to operation of the pilot valve, to premit free flow of pilot hydraulic fluid from the pilot valve to the directional control valve but to restrict flow of the pilot hydraulic fluid from the directional control valve to the pilot valve, wherein said body block is formed therein with a first passage connected to a return line for discharging the pilot hydraulic fluid vented by said relief valve whereby said at least one flow control valve is heated by the pilot hydraulic fluid generated by said relief valve in said first passage.

2. A valve apparatus as set forth in claim 1, wherein said relief valve is incorporated said body block.

3. A valve apparatus as set forth in claim 1, wherein said body block is formed therein with a second passage communicating said first passage and said pilot lines with each other, and the second passage is provided therein with a check valve preventing flow of the hydraulic fluid from the pilot lines to the first passage.

4. A valve apparatus as set forth in any one of claims 1 to 3, wherein said flow control valve is a pressure-compensated flow control valve.

* * * * *